US010519625B2

(12) United States Patent
Quidiante Diaz

(10) Patent No.: US 10,519,625 B2
(45) Date of Patent: Dec. 31, 2019

(54) DREDGER ACTUATED FROM LAND

(71) Applicant: Heriberto Floridor Quidiante Diaz, Quellon (CL)

(72) Inventor: Heriberto Floridor Quidiante Diaz, Quellon (CL)

( * ) Notice: Subject to any disclaimer, the term of this patent is extended or adjusted under 35 U.S.C. 154(b) by 0 days.

(21) Appl. No.: 16/227,344

(22) Filed: Dec. 20, 2018

(65) Prior Publication Data

US 2019/0119882 A1 Apr. 25, 2019

Related U.S. Application Data

(63) Continuation-in-part of application No. 15/027,741, filed as application No. PCT/CL2013/000073 on Oct. 9, 2013, now abandoned.

(51) Int. Cl.
*E02F 5/28* (2006.01)
*E02F 7/02* (2006.01)

(52) U.S. Cl.
CPC ..... *E02F 5/285* (2013.01); *E02F 7/023* (2013.01)

(58) Field of Classification Search
CPC ..... E02F 5/285; E02F 7/023; E02F 3/8833; E02F 3/88; E02F 3/8808
See application file for complete search history.

(56) References Cited

U.S. PATENT DOCUMENTS

| | | | | |
|---|---|---|---|---|
| 1,034,501 A | | 8/1912 | Peterson | |
| 3,057,139 A | | 10/1962 | Lane | |
| 3,276,152 A | | 10/1966 | Knap | |
| 3,804,177 A | * | 4/1974 | Renfroe | E02F 5/285 172/26.5 |
| 3,829,161 A | | 8/1974 | Wirtgen | |
| 4,957,622 A | * | 9/1990 | Mims | B01D 21/245 210/170.04 |
| 6,408,778 B1 | | 6/2002 | Wood, II | |

FOREIGN PATENT DOCUMENTS

ES 2099244 T3 5/1997

* cited by examiner

*Primary Examiner* — Jamie L McGowan
(74) *Attorney, Agent, or Firm* — Bay State IP, LLC

(57) ABSTRACT

A dredging system for the removal and cleaning of sediment in bays, port entrances, navigable channels, docks, watercourses, lakes or reservoirs, which is provided with means for excavating, dragging and removing the bottom of the waterway and means for regulation and support, the driving force for which is provided from land, which facilitates extraction of sediments directly onto the land, immediately leaving a planar surface on the sea bed. The aforesaid is achieved by controlling the excavator means and very closely controlling the cutting depth, all in a shorter period of time and at lower cost.

2 Claims, 2 Drawing Sheets

DREDGER ACTUATED FROM LAND

CROSS REFERENCE TO RELATED APPLICATION

This application is a continuation-in-part and claims priority to and takes the benefit of U.S. patent application Ser. No. 15/027,741 filed on Apr. 7, 2016, which in turn is a National Phase application under § 371 for International Application No. PCT/CL2013/000073 having an international filing date of Oct. 9, 2013.

BACKGROUND OF THE INVENTION

Field of the Invention

The invention relates to a dredge for the extracting and cleaning of sediments in bays, access to ports, navigable channels, docks, water courses, lakes or reservoirs, provided with means of excavation, dragging, removal of the bottom, and means of regulation and of support, whose driving force is exerted from land, and not from a boat on the surface of the sea, as usually happens with existing dredgers according to the state of the art.

Description of the Related Art

The rivers and the swells drag sediments that are deposited in the bottom of the bays or sites of calmer waters where the ports are built, decreasing the depth of the same, and therefore the tonnage of the boats that access it. The ports that are filled with sediments must be dredged to increase or recover their original capacity. Increasing the draft in these ports facilitates maritime traffic and reduces the risk of stranding for ships.

The dredging operations have a significant environmental impact. They produce a substantial alteration to the aquatic environment affecting all the flora and fauna in a large radius around the worksite with the removal of sludge by suspension. These environmental impacts must be timely and conveniently evaluated in order to take into consideration possible measures to mitigate them.

Among the types of dredges are the following:

a) Spoon dredges.

They operate using a mobile arm that extracts the materials from the bottom.

b) Bucket dredges:

Small dippers extract the sediments.

c) Hydraulic suction dredges:

They are used in soft soils and are usually coupled to a floating pipeline through which the materials are carried to the shore.

With regard to the state of the art for dredgers in general, we can cite the patent ES 471.035, which refers to a dredger carrying a floating body, an arm that extends forward and has, at its front end, a dispersing tool, said arm being pivotably mounted at its rear end on the floating body, in order to be able to adopt a more or less submerged working position and a raised resting position, means of suspension of the arm to regulate its position, in which the arm is provided in two parts, of which the first part is mounted pivotably at its rear end around a horizontal axis on the front end of said first part of the arm, while the second part of the arm is movably mounted on said platform, characterized in that, on the one hand, means are provided for maintaining the horizontal platform and, on the other hand, the movable assembly of the second part of the arm on said platform consists of a pivoting assembly around a vertical axis.

Another patent of invention, is the ES 2,099,244, which refers to a dredger provided with at least one tube (5) adjustable at an arbitrary angle, containing a scarifying tape (6) for the excavation of sludge and other light sediments, characterized in that the scarifying belt (6) extends to the lowest part of said tube (5), whose lower part of the tube (5) ends in a scarifying blade (9") so that the sludge and other light sediments can be transported along said tube (5).

Another patent of invention is the U.S. Pat. No. 3,276,152, Submarine Scraper of George Knap, which refers to a dredge towed from the ground by cables on the bottom, which moves on wheels and not on hollow skids that can be flooded to give buoyancy when moving water with compressed air, with a principle similar to that of submarines. Neither does it consider environmental issues.

Another patent of invention is U.S. Pat. No. 6,408,778 B1 by Donald M Wood, which describes a boat lift to retrieve boats from one location and then move to another location by using a fixed longitudinal system operatively connected to a winch that moves a mounted carrier frame on wheels back and forth between a first position on the ground and a second normal position on an immediately adjacent lake, river, or ocean. The wheels are at least partially hydraulic to keep the wheels in contact with the ground surface. In this case, the invention has some common elements such as the winch on land, but unlike the invention subject of this application, it moves on wheels, has no buoyancy, and does not consider any type of environmental measure.

SUMMARY OF THE INVENTION

In order to reduce operating costs, a large part of the task involving a specialized high-capacity vessel, the costs of docking and unloading, as well as the greater motor power to operate, the dredger of this invention is installed on land and not at sea as usually happens in existing dredgers in the state of the art.

The dredger is equipped with wide flat skids, watertight and hydrodynamic with a flotation capacity greater than the entire weight of the machine. This allows to:

a) Drag it offshore floating with a minimum force exerted from a smaller boat equipped with a winch.

b) Lighten it or make it heavier in order to regulate its pressure on the seabed, and to prevent it from being buried in soft bottoms, or to help the penetration of the blade in hard bottoms.

The buoyancy is regulated by a valve that can be operated by remote control on compressed air balloons or operated directly by a diver that inject air into these hollow skids.

To mitigate the suspended solids, which produce a great impact on the macro and microscopic flora and fauna in a wide radius around the worksite, increased by the effects of currents and/or swells, the dredger has installed on the central beam and above the blade a piece of elongated metal, which is a flattened tube, with a thin opening elongated across the front and length of the blade. This piece of metal is connected by a hose to a suction pump installed on the structure. The pump sucks through this long opening on the blade, the mud that the work raises from the bottom, but not the larger particles that quickly decant. This water with mud is conducted to the ground by means of a hose, to a decanter or separator of solids (not shown).

The dredging of the seabed is used to increase the draft for the larger ships. The existing machines in the dredging of the surface leave an uneven seabed and there is no way to extract material while maintaining the bottom even. Leaving the bottom even would imply a very high additional cost, but this dredger does it in its normal operation.

With this new dredging machine of the invention, it is easier to take the material directly to the ground avoiding all the costs of docking; and immediately leaving a smooth surface on the seabed, in addition to mitigating the environmental impact.

BRIEF DESCRIPTION OF THE DRAWINGS

To understand more easily the conformation and technical characteristics of the dredger of the invention, we will describe it in part to the drawings that are an integral part, without this meaning to limit it or obvious modifications that could arise, where.

DETAILED DESCRIPTION OF THE SEVERAL EMBODIMENTS

Figure 1:
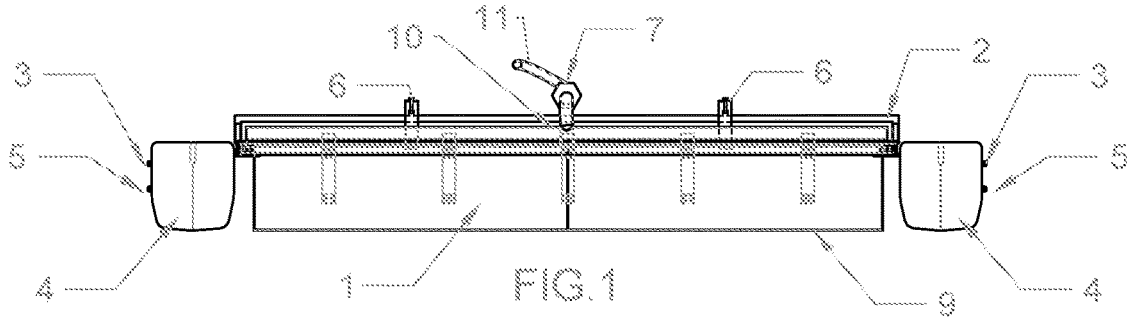
FIG. 1 shows an isometric view of the dredger of the invention.
Figure 2:
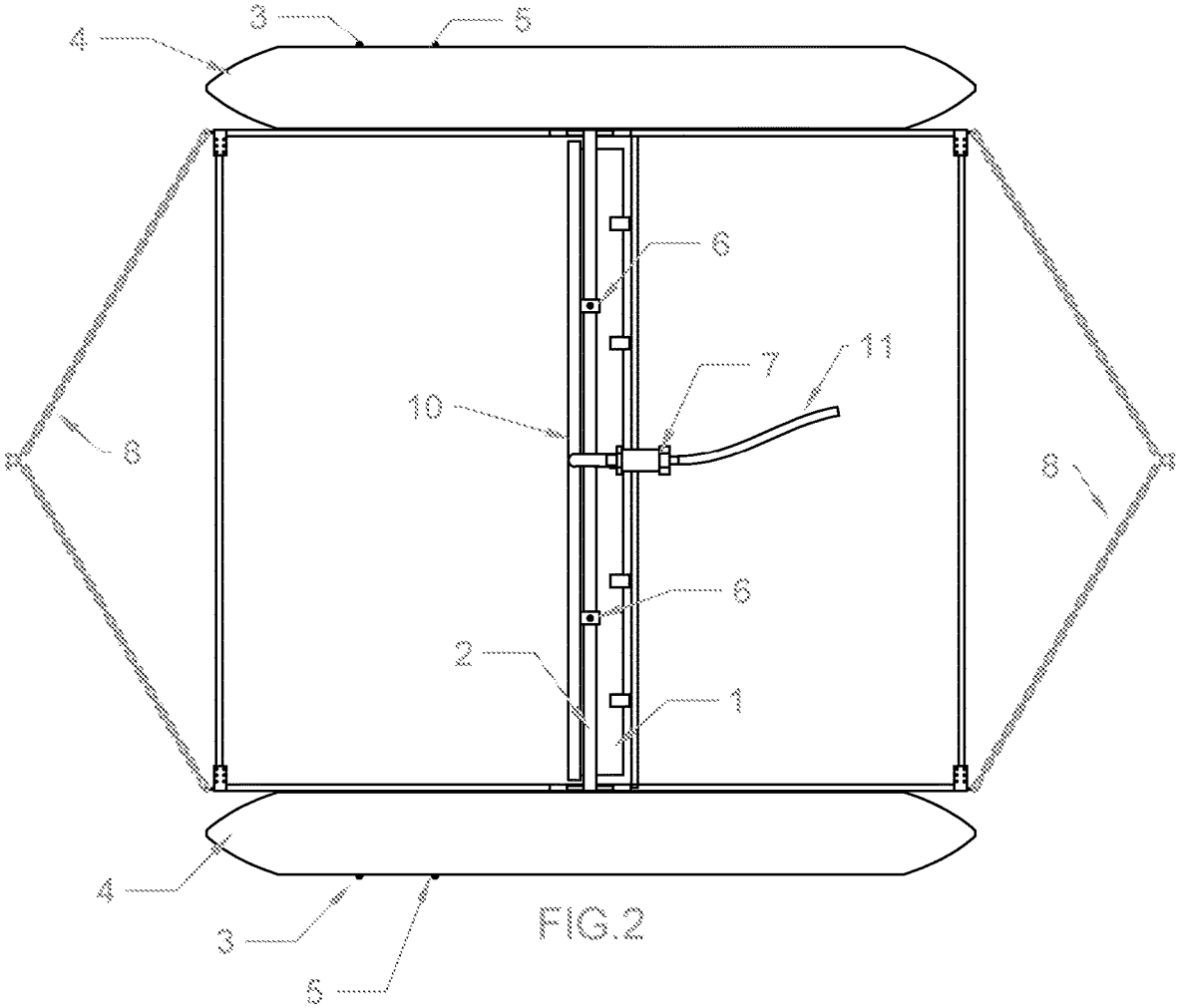
FIG. 2 shows a view in lateral elevation of the dredger of the invention.
Figure 3:
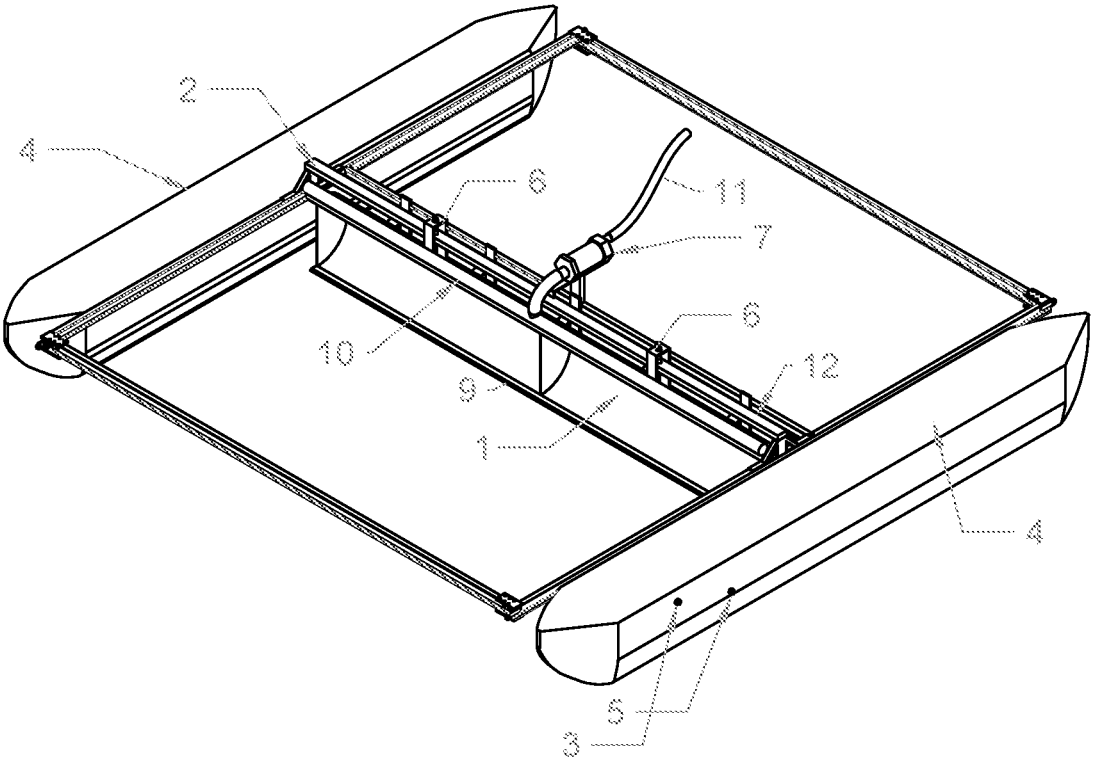
FIG. 3 shows a front elevation view of the dredger of the invention.
Figure 4:
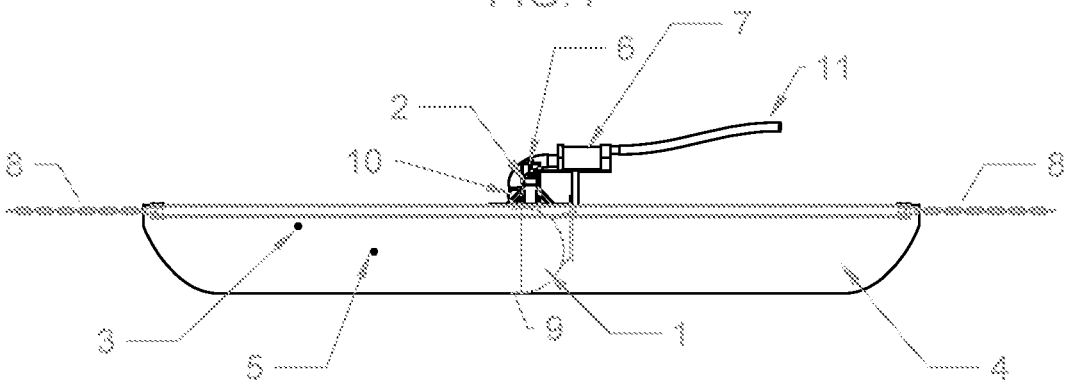
FIG. 4 shows a top plan view of the dredger of the invention.

In attention to FIGS. 1 to 4, the invention is a dredge with systems of flotation and capture of sediment or similar, is equipped with a drag blade (1) with vertical movement through the use of a hydraulic or mechanical mechanism (6) to regulate the cut (drag angle of attack), it has been created for the sweeping or dragging and extraction of material under water or dredging. Said blade (1) is driven (or dragged) by two winches anchored by chains (not illustrated) at a suitable distance to the surface to be dredged; they are connected to a chain in crow's feet (8) that takes the dredge from long-girder beams (2) corresponding to the frame of the dredger, which has two or four systems or means of wide, watertight and hydrodynamic skids (4), to be dragged with an angle of attack of a lower blade (9) located on the lower perimeter edge of the dredger. As the sediment material to be extracted may be soft, the broad surface of said skids (4) covers a large contact area so that it does not sink into it. These skids (4) being watertight can be flooded inside to make them heavier, or emptied to give buoyancy to the dredger, which helps to lighten the weight of the entire structure or frame of the dredge. The frame has the particularity that its framework is removable for its transport that is why part of its beams (2) and (12) are bolted. On the structure it carries a graduated ruler used to control the progress of dredging. The main winch (not illustrated) becomes firm at an anchor point on the beach. Another winch (not shown) is on the boat offshore, which is anchored and is responsible for returning the blade (1) to the point where it begins to remove the material, this winch does not need much power but more speed to position the dredger at its starting point. This is because the drag is made from the smaller boat with the dredge floating freely on its lateral air-tight skids.

The skids (4), are two or four hollow rounded structures of hydrodynamic shape, located on the sides of the longitudinal beams (2), said skids (4) during the task prevent the blade (1) from sinking into the substrate when it is pulled, since they are watertight and of a certain volume, they have the capacity to be flooded or to be kept full of air, which allows to regulate the weight of the dredge machine. This is achieved by the entry of compressed air through one valve (3), which by the injection of pressurized air extracts the water that leaves through a second valve (5), then these valves are closed once the depth of cut is adjusted.

To mitigate the environmental impact, the dredge has installed on the central beam (12) and above the blade (1) a tubular piece of elongated metal (10), which is a flattened tube, with a thin opening elongated across the front and the length of the blade. This piece of metal is connected by a hose to a suction pump (7) installed on the same beam (12). The pump sucks through this long opening on the blade, the mud that the work lifts from the bottom. This water with mud is conducted to the ground by means of a hose (11), to a decanter or separator of solids (not shown).

DIAGRAM AND PARTS OF THE DREDGER

1: drag blade.
2: vertical beam.
3: air inlet valve
4: skids.
5: water outlet valve
6: arch blade adjustment bracket
7. Motor pump
8: chain in crow's tooth.
9: blade.
10. Suction mouth
11. Sludge extraction hose
12. Central beam

What is claimed is:

1. A dredging system configured for an extraction and cleaning of sediments comprising:

a frame, wherein the frame comprises at least two longitudinal beams and a central beam;

a drag blade;

at least two chains;

a hydraulic mechanism, wherein the hydraulic mechanism is located on the drag blade and allows for vertical movement of the drag blade;

at least two watertight skids connected to the frame, wherein the watertight skids allow floatation of the dredging system;

a lower blade located on a lower perimeter edge of the drag blade;

a suction mouth located on the central beam;

a suction pump located on the central beam and connected to the suction mouth via a hose;

a extraction hose, wherein the extraction hose carries the extracted sediments;

wherein the driving force of the dredging system is exerted from a land surface and not from a vessel on a water surface;

wherein the suction mouth is installed on the central beam above the drag blade and is a flattened tube with a thin opening, elongated across a front and length of the drag blade such that the suction mouth is connected by the hose via the suction pump installed on the central beam; and wherein the suction pump sucks mud and sludge from a bottom through the thin opening and the mud and sludge is driven through the extraction hose.

2. The dredging system of claim 1, wherein the watertight skids further comprise:

an air inlet valve; and a water outlet valve;

wherein the skids are configured to be flooded to provide buoyancy and reduce the depth of the cut by relieving the weight of the dredging system.

* * * * *